US007908907B1

(12) United States Patent
Nelson et al.

(10) Patent No.: US 7,908,907 B1
(45) Date of Patent: Mar. 22, 2011

(54) METHOD OF MATCHING GOLFER SKILLS WITH GOLF BALL PERFORMANCE

(75) Inventors: Anthony A. Nelson, Bradenton, FL (US); Dennis Schreiner, Medina, OH (US)

(73) Assignee: Advanced Golf Solutions, LLC, Medina, OH (US)

( * ) Notice: Subject to any disclaimer, the term of this patent is extended or adjusted under 35 U.S.C. 154(b) by 57 days.

(21) Appl. No.: 12/228,951

(22) Filed: Aug. 18, 2008

(51) Int. Cl.
*A63B 53/00* (2006.01)

(52) U.S. Cl. ..... 73/65.03

(58) Field of Classification Search ..... 73/65.01, 73/65.03; 473/373, 374, 378; 702/182
See application file for complete search history.

(56) References Cited

U.S. PATENT DOCUMENTS 6,416,428 B1 7/2002 Tygar et al.
6,547,671 B1 4/2003 Mihran
6,571,600 B2 6/2003 Bissonnette et al.
6,616,550 B2 * 9/2003 Nesbitt et al. ..... 473/374
6,644,294 B2 11/2003 Christensen
6,760,685 B2 * 7/2004 Boehm ..... 702/182
6,804,988 B2 10/2004 McNamara et al.
6,923,039 B2 8/2005 Bissonnette et al.
7,150,178 B2 12/2006 Bissonnette et al.
7,166,035 B2 1/2007 Voges et al.
7,621,828 B2 * 11/2009 Voges et al. ..... 473/409
2007/0060410 A1 3/2007 Gobush
2008/0021651 A1 1/2008 Seeley et al.

* cited by examiner

*Primary Examiner* — Lisa M Caputo
*Assistant Examiner* — Octavia Davis
(74) *Attorney, Agent, or Firm* — Charles J. Prescott

(57) ABSTRACT

A method of matching a golfer's skills to a particular brand of golf balls by first testing a golfer's skills using a golf launch monitor, the data derived from this test being entered into an extensive computerized system of research databases. Further test results are taken for putting comparisons between all brands within the system. A final category known as "the feel index" is also tested and entered into the computer database. Based upon the results and golfer preference towards distance, accuracy, putting and feel, the top brand is selected for that person. This brand is then subjected to a series of air cannon tests to determine the performance characteristics of each ball. The balls are then subdivided into groups and performance rated for consistency.

5 Claims, 1 Drawing Sheet

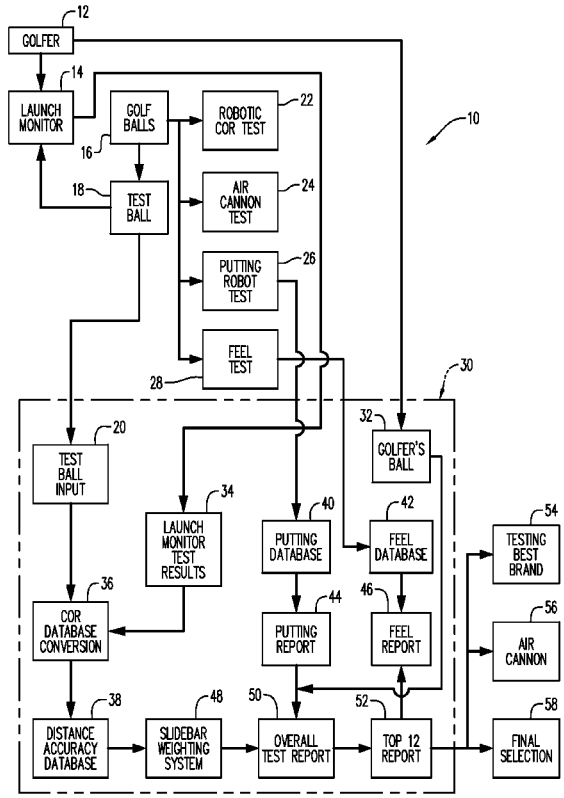

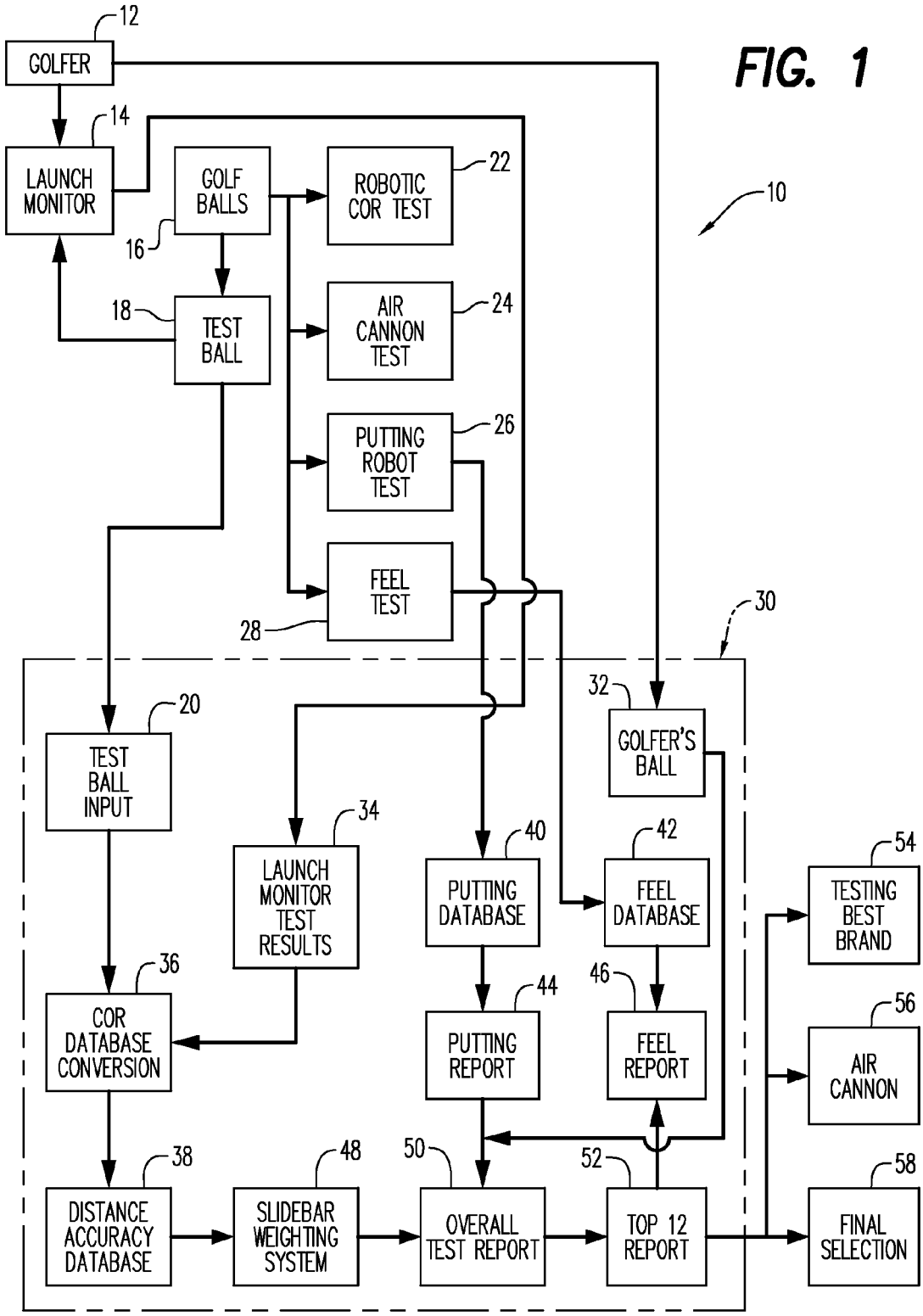
FIG. 1
10
12
GOLFER
14
LAUNCH MONITOR
16
GOLF BALLS
18
TEST BALL
22
ROBOTIC COR TEST
24
AIR CANNON TEST
26
PUTTING ROBOT TEST
28
FEEL TEST
30
20
TEST BALL INPUT
32
GOLFER'S BALL
34
LAUNCH MONITOR TEST RESULTS
40
PUTTING DATABASE
42
FEEL DATABASE
36
COR DATABASE CONVERSION
44
PUTTING REPORT
46
FEEL REPORT
38
DISTANCE ACCURACY DATABASE
48
SLIDEBAR WEIGHTING SYSTEM
50
OVERALL TEST REPORT
52
TOP 12 REPORT
54
TESTING BEST BRAND
56
AIR CANNON
58
FINAL SELECTION

METHOD OF MATCHING GOLFER SKILLS WITH GOLF BALL PERFORMANCE

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to golf and more specifically to matching a golfer's tested skills with the tested performance of a broad array of golf balls to achieve optimal golf ball distance and consistency.

2. Description of Related Art

Systems for golf ball fitting are well known. Conventional methods for finding the best golf ball for a golfer derive from the golfer actually playing rounds of golf with different brands and then deciding which brand is best. Obviously this method has its faults. Not only is it extremely time consuming but it can be very expensive. Another method for golf ball selection is to go to a retail store and go through a ball fitting system. Most of these systems are designed by the golf ball manufacturers and are only applicable to the brands they make. Still another method is to categorize golfers based upon their ability levels and then lump them into categories matching specific brands.

Four patents assigned to Acushnet Company, invented by Bissonnette, et al. disclose general golf ball testing machines and methods for measurement of Coefficient Of Restitution (COR) and contact time of golf balls. U.S. Pat. No. 6,571,600 teaching an apparatus and method for quantifying the stiffness of a golf ball or COR, while also measuring contact time. The apparatus is an air cannon providing means for velocity measurement. U.S. Pat. No. 6,804,988 discloses an automated machine for testing physical properties of golf balls and U.S. Pat. No. 6,923,039 discloses the method and apparatus for measuring the coefficient of restitution of a golf ball following simulated hitting by an actual golf club. The '178 patent is a continuation of the '988 and '600 patents.

Christensen discloses a golf ball projecting air cannon capable of projecting a golf ball or paint ball beyond 100 yards in U.S. Pat. No. 6,644,294. Tygar, et al. discloses a pneumatic golf ball launching device in U.S. Pat. No. 6,416,428.

A performance assessment and information system is taught by Seeley, et al. in U.S. published application 2008/0021651 which is designed to measure, calculate, derive and analyze the ball movement and ball-oriented characteristics in order to provide an assessment of the player's performance.

U.S. Pat. No. 6,547,671 to Mihran teaches a device for providing for the accurate determination of the launch angle of a golf ball after being struck by a golf ball. Voges, et al. teaches systems and methods using advanced technology for identifying the optimum equipment for a golfer in U.S. Pat. No. 7,166,035. Gobush describes a method and apparatus for measuring ball launch conditions in U.S. published application 2007/0060410.

The foregoing examples of the related art and limitations related therewith are intended to be illustrative and not exclusive. Other limitations of the related art will become apparent to those skilled in the art upon a reading of the specification and a study of the drawings.

BRIEF SUMMARY OF THE INVENTION

Since all golfers are unique in their swing characteristics it is most important to determine how that unique swing impacts the golf ball. The golf ball speed, golf ball spin rate and the golf ball launch angle immediately upon impact are the most critical pieces of information needed to determine how a golf ball will perform. With the development of golf launch monitors it is now readily available for golfers to gather this data. It was necessary to develop a database system to compare a plurality of golf balls based on this available data. A testing method was established to compare these golf balls against one another at various tests. To insure complete accuracy in testing specialized testing equipment had to be built to perform exacting tests. A centrifugal force rotary robot was designed to perform impact tests.

An air cannon system was designed to conduct golf ball aerodynamic performance testing. This air cannon is or will soon be the subject of a separate patent application. A pendulum-putting machine was also designed to conduct putting tests. Other equipment that is standard to the golf industry such as durometers, compression testers, chronographs and launch monitors were used in testing. Traditional robots and air cannons common to the golf industry could not be used to conduct tests. Golf robots such as "Iron Byron" are designed to swing golf clubs and simulate a real golfers swing. The problem is their inability to generate the same exact strike on the golf ball each time. The inconsistency in shaft bending and impact locations on the golf face will skew golf ball comparison studies. Therefore a pendulum type centrifuge was designed to swing in a perfect circle allowing for the golf ball to be struck in the same exact location every time. The speed can be controlled through a servomotor and the launch angle can be altered via the hitting blocks attached to the end of the shaft. An air cannon system had to be designed that could shoot the golf balls at various speeds, launch angles and spin rates without the impact of a golf club. Since the amount of times a golf ball can be struck with a golf club is limited before damage occurs, a no impact device had to be designed. This equipment is necessary to develop the golf ball comparison testing databases. Finally it is known that all golf balls within a given brand do not perform exactly the same. This is true because of manufacturing tolerances. Therefore it is necessary to not only determine which brand is best for a golfer but then that brand should be tested for consistency.

This invention is directed to a method of matching a golfer's skills to a particular brand of golf balls by first testing a golfer's skills using a golf launch monitor, the data derived from this test being entered into an extensive computerized system of research databases. Further test results are taken for putting comparisons between all brands within the system. A final category known as "the feel index" is also tested and entered into the computer database. Based upon the results and golfer preference towards distance, accuracy, putting and feel, the top brand is selected for that person. This brand is then subjected to a series of air cannon tests to determine the performance characteristics of each ball. The balls are then subdivided into groups and performance rated for consistency.

The following embodiments and aspects thereof are described and illustrated in conjunction with systems, tools and methods which are meant to be exemplary and illustrative and not limiting in scope. In various embodiments one or more of the above-described problems have been reduced or eliminated while other embodiments are directed to other improvements. In addition to the exemplary aspects and embodiments described above, further aspects and embodiments will become apparent by reference to the drawings and by study of the following descriptions.

BRIEF DESCRIPTION OF THE SEVERAL VIEWS OF THE DRAWING(S)

FIG. 1 is a block diagram of the system and methodology of the present invention.

Exemplary embodiments are illustrated in reference figures of the drawings. It is intended that the embodiments and figures disclosed herein are to be considered to be illustrative rather than limiting.

DETAILED DESCRIPTION OF THE INVENTION

Overview

Referring now to FIG. 1, a schematic or block diagram of the methodology of the present invention and software block diagram 30 therewithin is there shown generally at numeral 10. This methodology 10 begins with a golfer 12 who is to be tested for determining the best suited golf ball brand for that golfer 12 as described below. This golf ball brand identification process begins with utilizing the launch monitor 14 which measures golf ball speed, launch angle and spin rate upon impact with the head of the golfer's golf club. The launch monitor 14 is also used in the methodology on a selected array of golf balls 16 wherein each golf ball 18 is subjected to testing by an air cannon 24 with the launch monitor 14 to generate an array of test data derived from the launch monitor 14.

Each of the golf ball brands is subjected to four separate tests, the robotic COR test 22, the air cannon test 24, the putting robot test 26 and the feel test 28. The robotic COR test evaluates each golf ball brand at various launch angles and speeds, as well as collecting data sufficient to determine the Coefficient Of Restitution (COR) for each golf ball brand. The air cannon test 24 propels each brand of golf ball at various launch angles, golf ball speeds, spin rates, spin rate axis of orientation to establish distance and accuracy data. The putting robot test 26 determines putting roll distance and accuracy. The feel test 28 evaluates cover hardness and compression to determine a softness/feel factor for each golf ball brand. These tests are described more fully herebelow.

The launch monitor test results at 34 are merged with the test ball input at 20 from the launch monitor at 14 developed for each golfer 12 into a COR database conversion at 36. The COR test results are then sent to a distance/accuracy database 38 where a look-up of the database produces carry distance, carry off line, total distance and total off line data for each golf ball brand and compared.

The putting robot test data at 26 is then communicated into the software program 30 to the putting database 40 to produce comparison data for distance and accuracy for all brands for putting. A putting report 44 is produced which, when combined with the particular golf ball brand used by the golfer at 32, produces an overall test report at 50 showing the carry distance, total distance, carry offline, total offline, and COR data for all brands, and makes recommendations for best golf ball brands suiting the golfer. The golfer 12 has already chosen at 48 a percentile slide scale weighted between distance and accuracy for all brands of golf balls.

At 52, a final top twelve report is generated showing the golfer 12 the preferred selection order for golf ball brands with respect to distance and accuracy performance of these top twelve golf ball brands. From there, several golf balls from each of the top brands are selected by the golfer 12 to be air cannon sorted at 54. Those selected golf balls of the selected brands are then air canon tested at 56, with the air cannon being calibrated to meet the particular golfer's previously generated shot profile based upon the data collected in the launch monitor test at 14. The golf balls tested by the air cannon at 56 are sorted into categories by order of performance, those being selected exhibiting the tightest dispersion pattern by performance sequence.

To better understand the methodology generally described above, it will be broken down into four distinct sections.

1. Testing the golfer to obtain a performance profile;
2. Testing to determine how various golf ball performances compare;
3. Comparison software program which utilizes the test results to select the best golf ball brands; and
4. Choosing golf balls from the best brands and then testing them for consistency.

Testing the Golfer

A golfer must be tested with a golf launch monitor system to gather important data. There are several different brands and styles of launch monitors available. One method utilizes high speed photography. A second method utilizes phase array radar. In either case, these methods gather similar information defining the ball speed post impact, the backspin rate post impact, and the launch angle post impact, as well as attempting to predict where the golf ball goes in relationship to a specific target, although not necessary.

To conduct this test, a golfer is provided ample opportunity to warm up and should be required to perform stretching exercises and then to hit numerous golf balls. Once the golfer is ready, the technician should record some pertinent data from the golfer. The specific club used to conduct the test, the brand of golf ball the customer currently is using, and the brand of golf ball used in the test. The test golf balls should be inspected often and replaced if any damage has occurred to the cores or cover. Only golf balls that are within the software database system should be used to conduct tests. The golfer should be required to hit approximately 6-10 shots with the appropriate test ball and the data should be recorded via a launch monitor. The technician should select only shots that are best representative of that golfer. Once the test is completed, the data is then averaged using a standard means of deviation to determine the profile for that player.

Field Research

First, a study is conducted to determine which golf balls are to be included in the system. A listing is compiled from the golf ball manufacturers as to the golf balls that are approved by the USGA that will be on the market. A second listing is conducted with golf equipment retailers to determine which products they intend to carry in the stores. Each company is then asked for a submission of 3 dozen of each brand of golf ball for testing. These golf balls then are marked with an identifying number and then placed into a saline solution and allowed to float. A marking pen is used to place a small dot on the top of the golf ball to indicate the lightest point of the golf ball. The balls are then placed in a round gauge and a second dot is marked on the golf ball, with a different colored marking pen, exactly opposite the original dot. This second dot represents the heaviest side of the golf ball. Each golf ball is then placed in a high-speed centrifuge and spun at a high speed. The centrifugal force pulls the heaviest side outward and a marking pen is placed through a small hole on the side of the centrifuge located at the golf balls equator. The tip of the pen is placed lightly against the golf ball to create a line around the ball. This line will pass through the original two dots placed on the ball from the floating test. The ball is then placed back in the round gauge while a second circle is drawn around the golf ball opposite the first circle. The golf balls are then separated into categories. One dozen of each brand are sorted and used for putting and "feel" tests. A second dozen of each brand is sorted and used for coefficient of restitution (COR) tests. The remaining dozen is then used for the aerodynamic tests.

Putting Tests

The (12) golf ball samples are randomly selected and placed on the putting platform in an exact location. The pendulum putter is adjusted to strike the ball in the clubface center. The balls are positioned on the platform in multitudes of orientations with the lightest side of the golf ball being adjusted to a different location each time. The putter is pulled back to the stopping point then released. The putter is a gravity fed device that always maintains the exact same speed. The ball is then struck with the putter head and travels down the platform, the platform first having been leveled and markings are placed on the platform to form a grid. The point at which each golf ball comes to rest on the grid is measured and charted. A total distance and offline disthnce are recorded for each putt. The platform is designed to create a green speed of 10.5 on a STIMPMETER. This procedure is repeated multiple times and the data is recorded. All putting tests are performed indoors under a common temperature and conditions.

Feel Tests

This same dozen balls used for putting are then tested for compression and cover hardness. Each ball is subjected to several tests at various locations with a durometer tester to measure the cover hardness of the golf ball. The results are recorded for each ball onto a spreadsheet. The compression is then measured multiple times for each golf ball. These readings are recorded onto a second spreadsheet: The readings are averaged through a means of standard deviation and a feel index is created for each brand by use of the calculations dealing with cover durometer, and compression.

Coefficient of Restitution (COR) Test

Each golf ball of another group of (12) is subjected to a series of tests using a golfing robot. The robot is programmed at various hitting block speeds. This robot is powered by a servo motor system and is programmable to repeat the same exact hitting block speed within 0.1 MPH. Hitting blocks are attached to the end of the robot shaft that have varying angled faces. A launch monitor is used to record the ball speed, launch angle and spin rate data for each shot. All tests are preformed in a common environment for temperature. The balls are placed on an adjustable tee that positions the golf ball to be struck in the exact center of the hitting block. A laser is used to measure the face of the hitting block to make sure it is square to the target line and parallel to the launch monitor. The golf balls are placed on the tee in multiple orientations. A series of shots are conducted at a common speed using multiple hitting blocks. A second series of tests is performed at a higher speed and finally a 3$^{rd}$ series of tests are performed at an even higher rate of speed. The data is then transferred to a spread sheet and a golf ball COR profile is created for each brand of ball tested displaying the ball speed, launch angle and spin rate.

Using a standard average means of deviation, an average is assigned to each category of ball speed, launch angle and spin rate for each brand of golf ball tested. One specific brand of golf ball tested is selected as the default ball. The ball speed of each brand tested is divided by the ball speed of the default golf ball to determine a ratio. The same procedure is used for launch angle and spin rates. Three distinct ratios are established for each brand of golf ball.

EXAMPLE 1

Actual Testing Results by Brand

| Golf Ball Brand | Ball Speed mph | Launch Angle degrees | Spin Rate rpm |
|---|---|---|---|
| Bridgestone B-330 (Default Ball) | 150.00 | 12.25 | 3500 |
| Titlesist Pro V1 | 150.50 | 12.63 | 3799 |
| Wilson Hope | 149.10 | 12.40 | 3850 |

This date is then used to develop a COR ratio data base for all brands.

EXAMPLE 2

COR ratio data base

| Golf Ball Brand | Ball Speed mph | Launch Angle degrees | Spin Rate rpm |
|---|---|---|---|
| Bridgestone B-330 (Default Ball) | 1.0 | 1.0 | 1.0 |
| Titlesist Pro V1 | 1.003 | 1.03 | 1.085 |
| Wilson Hope | 0.994 | 1.01 | 1.10 |

Hitting Block Design

Test hitting blocks feature multiple lofts, adjustable center of gravity, multiple weighing systems and multiple testing plates.

A series of hitting blocks were designed with various lofts.

Each block is milled to within 0.01 degrees of the desired value.

The blocks were made in 2 degree loft increments from 6 to 38 degrees.

Each block has a steel facing plate approximately 0.035" in thickness.

These plates were heat treated to a Rockwell C-20 Hardness.

They have an abraded surface (performed by the Golfworks) which is equal to the USGA standard.

Each surface was chrome plated to prevent surface rusting.

The blocks have an adjustable weighting system to alter the overall weight and the center of gravity location whereby the spin rates may be changed on balls being tested.

Different Scoring Line Surfaces are attached to various blocks.

Aerodynamic Tests with an Air Cannon

The purpose of the golf ball cannon is to replicate the flight of golf balls when struck by a golfer. The cannon is capable or creating any ball speed from a minimum of 35 MPH to a high speed of 185 MPH. The angle of launch can be adjusted from a low of 0 degrees to a high of 45 degrees and the spin rate can be set with a low value of 0 RPM's to a high value of 10,000 RPM's. The cannon can also be rotated on its axis to generate sidespin from a low value of 0 RPM's to a high value of 10,000 RPM's in either direction, left or right which will allow for slicing and hooking patterns. These parameters will allow the cannon to duplicate the flight pattern of virtually any golf shot that can be created by a human being. The concept is to be able to shoot a default brand golf ball at various launch angles, spin rates and ball speeds to determine the flight characteristics of that brand. This information will be useful in developing ball fitting and club fitting systems. The cannon can also be used to check golf balls for consistency. The data generated from the cannon can be useful in creating optimum flight modules to help golfers improve their games.

The cannon uses pneumatic air pressure to propel the golf ball. The ball is held inside the barrel by a specially clamping device that is powered by pneumatics. The same device is used to spin the golf ball to create backspin. This is powered by a servomotor. An electronic actuator is used to open and close a ball valve to allow for the release of air to propel the golf ball from the barrel. A regulator is used to moderate the amount of air pressure which controls the speed of the golf ball. The barrel is adjusted vertically to create the desired launch angle. The cannon is then rotated on its axis to the desired degree to create the desired amount of sidespin.

The entire system runs off a smart motor interface system that adjusts the controls of all the devices. The program is set to clamp the golf ball, then turn on the servo motor, bring the ball speed to the desired setting, then simultaneously relax the crimpers and open the ball valve to allow the air to flow against the golf ball thus propelling the spinning ball from the barrel. The ball then passes through a speed trap upon exiting the barrel to measure the exact ball speed.

The air cannon testing is the most critical part of this testing methodology. The golf balls are placed in the barrel of an air cannon in various positions. The cannon is adjustable to create virtually any ball speed, launch angle and spin rate that can be created by a golfer. A series of tests are conducted at various ball speeds, launch angles and spin rates to develop a database for carry distance, total distance and accuracy for each brand based on the launch angle, spin rate and ball speed parameters. These balls are shot outdoors onto a field that is lined and measured. A technician in the field charts the exact landing point for each golf ball. The carry distance, carry offline distance; total distance with roll and total offline distance with roll are also measured and recorded. Weather conditions including temperature, humidity, wind direction and wind speed are recorded for each shot. Comparison testing must be conducted in common weather conditions so as not to skew results. Wind speed cannot exceed 3 MPH or it will affect the ball flight.

This data is used to develop a three dimensional "look up" database of total distance, carry distance, and offline accuracy for the software program.

EXAMPLE 3

Test Parameters of Ball Speed 150 MPH, Launch Angle 12.25 Degrees, Spin Rate 3500 RPM

| Golf Ball Brand | Carry Dist. yds | Total Dist. yds | Accuracy Off Line yds |
|---|---|---|---|
| Bridgestone B-330 (Default Ball) | 240.5 | 254.9 | 2.34 |
| Titlesist Pro V1 | 237.2 | 250.3 | 1.11 |
| Wilson Hope | 226.2 | 235.8 | 5.12 |

How the Air Cannon Works

The Golf 2 Air Cannon software is opened with a laptop computer. The desired spin rate for the golf test being conducted is entered into the software. That speed setting will remain constant through the entire test. The air pressure is set for the cannon. The air passes through a regulator and the pressure is set. Air pressure controls the amount of pressure applied to the golf ball. This will propel the ball at a desired speed based upon the setting.

The fire button is then pressed. Immediately the ball clamps move inside the barrel and close grabbing the golf ball. The servo controller then send a speed signal to the motor and the motor spins at that desired setting e.g. 3500 RPM's. Once the motor reaches the desired speed a second signal is sent to the air clamps allowing them to relax the grip on the golf ball. Simultaneously a 3rd command is sent to the electronic ball valve. This allows for the valve to open and a direct blast of air is imparted on the golf ball.

The golf ball then is propelled out of the barrel at the desired ball speed, launch angle and backspin rate for that specific test. This procedure is repeated for each and every brand. The distance results for each shot are recorded by a field technician.

Ball Comparison Software

Once all the research is completed, the results are then used to create multiple databases within the software program. The software is designed for use with golf launch monitors. The technician must first configure the system to acknowledge the brand of launch monitor used to create the golfer data. A database is inside the software that adjusts the results based on the type of launch monitor used to create the test. All launch monitor brands do not interpret the data the same. An adjustment factor must be made within the software to correct this. Various comparison testing has been performed between all types of launch monitors to develop this database.

The golfer performance data is then entered into the appropriate places within the software including the average ball speed, launch angle and spin rate. The technician should also enter the brand of golf ball the golfer uses, as well as the brand of ball used to conduct the launch monitor test. This data is then sent to the COR profile database. The ball speed, launch angle and spin rates are then estimated for all the remaining brands of golf balls in the database system using the ratio table for each factor. This information is displayed in the program for all the brands of golf balls and is then used to "look up" the aerodynamic three-dimensional distance database to estimate the carry distance, total distance and accuracy offline for each brand based on the adjusted ball speed, launch angle and spin rate inputs.

The technician then must weight distance versus accuracy for the customer. Some golfers are more concerned with how far the golf ball goes and less concerned with how accurate it is. A sliding scale allows the technician to weigh from 100% weighting towards distance to 100% weighting for accuracy.

A blend of 50% Distance and 50% accuracy is preferred by most golfers. The brands of golf balls are then sorted in order of the weighting scale.

The technician may then print a report for the customer showing the comparisons between the brands. A second report can also be printed showing the feel index of each brand. A final report can be printed showing the putting performance of each brand. Based on the results of these reports the customer may select the golf ball brand that best suits his or her needs.

While a number of exemplary aspects and embodiments have been discussed above, those of skill in the art will recognize certain modifications, permeations and additions and subcombinations thereof. It is therefore intended that the following appended claims and claims hereinafter introduced are interpreted to include all such modifications, permeations, additions and subcombinations that are within their true spirit and scope.

The invention claimed is:

1. A method of matching the skills of a golfer with the performance characteristics of a golf ball brand comprising the steps of:

(a) determining an actual performance profile of the golfer using a golf club and golf ball brand used by the golfer by measuring flight characteristics of the golf ball, including distance, ball speed, spin rate and launch angle of a plurality of golf balls actually hit by the golfer and entering the golfer's performance data derived therefrom into a computer database;

(b) selecting a group of golf ball brands;

(e) determining a coefficient of restitution (COR) by measuring flight characteristics of each of the golf ball brands upon being hit by a hitting block simulating a golf club and entering a calculated COR for each of the golf ball brands into the computer database;

(f) determining actual flight characteristics and actual flight consistency of each of the golf ball brands including launch angle, spin rate, ball speed, carry distance, total distance, and offline accuracy when shot from an air cannon and entering the flight data into the computer database;

(g) comparing the COR, actual flight characteristics, and consistency of the golf ball brand used by the golfer in step (a) with all of the performance data of the golf ball brands in step (b);

(h) establishing a weighted scale of relative importance to the golfer between distance and accuracy (offline performance) based on step (a);

(i) determining an ordered group of golf ball brands established in step (g) based upon the weighted scale established in step (h).

2. The method of claim 1, further comprising:

after step (b), using a putting robot, determining actual putting performance profile of each of the golf ball brands selected and entering the golf ball performance data derived therefrom into the computer database.

3. The method of claim 1, further comprising:

after step (b), determining a feel index for each of the golf ball brands by measuring compression and cover hardness for each golf ball brand and entering the feel index data into the computer database.

4. The method of claim 1, further comprising:

after step (i), shooting a plurality of identical golf balls of each golf ball brand determined in step (i), the air cannon being adjusted to substantially duplicate the golfer performance profile determined in step (a), to identify the most consistent golf brands for distance and accuracy offline.

5. A method of matching the skills of a golfer with the performance characteristics of a golf ball brand comprising the steps of:

(a) determining an actual performance profile of the golfer using a golf club and golf ball brand used by the golfer by measuring flight characteristics of the golf ball, including distance, ball speed, spin rate and launch angle of a plurality of golf balls actually hit by the golfer and entering the golfer's performance data derived therefrom into a computer database;

(b) selecting a group of golf ball brands;

(c) after step (b), using a putting robot, determining actual putting performance profile of each of the golf ball brands selected and entering the golf ball performance data derived therefrom into the computer database;

(d) after step (b), determining a feel index for each of the golf ball brands by measuring compression and cover hardness for each golf ball brand and entering the feel index data into the computer database;

(e) determining a coefficient of restitution (COR) by measuring flight characteristics of each of the golf ball brands upon being hit by a hitting block simulating a golf club and entering a calculated COR for each of the golf ball brands into the computer database;

(f) determining actual flight characteristics and actual flight consistency of each of the golf ball brands including launch angle, spin rate, ball speed, carry distance, total distance, and offline accuracy when shot from an air cannon and entering the flight data into the computer database;

(g) comparing the COR, actual flight characteristics and consistency of the golf ball brand used by the golfer in step (a) with all of the performance data of the golf ball brands in step (b);

(h) establishing a weighted scale of relative importance to the golfer between distance and accuracy (offline performance) based on step (a);

(i) determining an ordered group of golf ball brands established in step (g) based upon the weighted scale established in step (h);

(j) after step (i), shooting a plurality of identical golf balls of each golf ball brand determined in step (i), the air cannon being adjusted to substantially duplicate the golfer performance profile determined in step (a), to identify the most consistent golf brands for distance and accuracy offline.

* * * * *